US006402639B1

(12) United States Patent
Iwata et al.

(10) Patent No.: US 6,402,639 B1
(45) Date of Patent: Jun. 11, 2002

(54) METAL WOOD CLUB HEAD

(75) Inventors: Mototaka Iwata; Naoyuki Masuda; Kiyoshi Sugimoto; Koji Sakai, all of Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/786,710

(22) PCT Filed: May 22, 2000

(86) PCT No.: PCT/JP00/03274

§ 371 (c)(1),
(2), (4) Date: Mar. 7, 2001

(87) PCT Pub. No.: WO01/32271

PCT Pub. Date: May 10, 2001

(30) Foreign Application Priority Data

Oct. 28, 1999 (JP) ..... 11-306868

(51) Int. Cl.[7] ..... A63B 53/04
(52) U.S. Cl. ..... 473/330; 473/45; 473/349
(58) Field of Search ..... 473/324, 329, 473/345, 346, 349, 342, 350, 290, 291, 330, 344, 327, 328

(56) References Cited

U.S. PATENT DOCUMENTS

| | | | | |
|---|---|---|---|---|
| 4,367,878 | A | * | 1/1983 | Schmidt |
| 4,432,549 | A | * | 2/1984 | Zebelean |
| 4,725,062 | A | * | 2/1988 | Kinney |
| 5,120,061 | A | * | 6/1992 | Tsuchida |
| 5,310,185 | A | | 5/1994 | Viollaz et al. |
| 5,346,217 | A | * | 9/1994 | Tsuchiya |
| 5,377,986 | A | * | 1/1995 | Viollaz |
| 5,398,935 | A | * | 3/1995 | Katayama |
| 5,415,405 | A | * | 5/1995 | Vincent |
| 5,482,280 | A | * | 1/1996 | Yamawaki |
| 5,851,160 | A | * | 12/1998 | Rugge |
| 5,935,020 | A | * | 8/1999 | Stites |
| 6,048,278 | A | * | 4/2000 | Meyer |
| 6,074,310 | A | * | 6/2000 | Ota |
| 6,193,614 | B1 | * | 2/2001 | Sasamoto |

FOREIGN PATENT DOCUMENTS

| | | |
|---|---|---|
| EP | 446935 | 9/1991 |
| JP | 6-15016 | 5/1994 |
| JP | 8-141116 | 6/1996 |
| JP | 9-192269 | 7/1997 |
| JP | 30407199 | 8/1997 |
| JP | 11-178956 | 7/1999 |
| JP | 11-290489 | 10/1999 |

* cited by examiner

*Primary Examiner*—Sebastiano Passaniti
(74) *Attorney, Agent, or Firm*—Troutman Sanders LLP; Gerald R. Boss

(57) ABSTRACT

A metal wood club head of a hollow hull structure according to the present invention is such that the vertical difference between a maximum face part height (MFH) from a sole part (4) and a back part height (BH) from the sole part (4) is at least within 25 mm, the height of a crown part (3) having a width of 30% to 70% of a head width from the sole part (4) is substantially identical to the maximum face part height (MFH) or more than that, the vertical difference between a maximum crown part height (MCH) from the sole part (4) and the maximum face part height (MFH) is at least within 8 mm, and the radius (R1) of curvature of the crown part (3) is substantially uniformly within the range of 100 mm to 1000 mm, while it sets the radius (R2) of curvature of the sole part (4) substantially uniformly within the range of 500 mm to 2000 mm, and sets the ratio of thicknesses of the crown part (3) and the sole part (4) within the range of 1.0 to 1.2.

8 Claims, 9 Drawing Sheets

DEFLECTION RATIO : 1. 00

ASPECT RATIO : 1. 00
DEFLECTION RATIO : 0. 95

ASPECT RATIO : 0. 56
DEFLECTION RATIO : 0. 91

ASPECT RATIO : 0. 44
DEFLECTION RATIO : 0. 88

ASPECT RATIO : 0. 36
DEFLECTION RATIO : 0. 82

ASPECT RATIO : 0. 25
DEFLECTION RATIO : 0. 75

ASPECT RATIO : 0. 11
DEFLECTION RATIO : 0. 60

METAL WOOD CLUB HEAD

This application claims priority based on Application PCT/JP00/03274, filed on May 22, 2000 and which claims priority from Japanese patent application 11-306868 (P) dated Oct. 28, 1999, entitled "Metal Wood Club Head."

TECHNICAL FIELD

The present invention relates to a metal wood golf club head, and more particularly, it relates to a metal wood club head bringing a wood club head of extra-large volume into a compact appearance shape, providing no feeling of misfit also when used by an upper-class person and capable of increasing a carry by remarkably improving restitution characteristics of the metal wood club head.

BACKGROUND ART

An example of a conventional golf club head is disclosed in Japanese Patent Laying-Open No. 6-15016, for example. In this gazette, there is disclosed a head prepared by bonding a plastic material or a composite material to a face part of a metal head and rendering it a hitting surface.

Another example of the golf club head is disclosed in Japanese Patent Laying-Open No. 9-192269. In this gazette, there is disclosed a metal wood club head prepared by molding a face part of a metal wood club head in the form of a roll and arranging a sweet spot under the face center of this face part, a head matching the top position of the face part formed in the shape of a roll with the aforementioned sweet spot.

As an item required to a golf club head, it is desired that restitution characteristics of the head is high in order to bring a sufficient carry to the player. In particular, a metal wood club head is used in a middle course or a long course, and a next shot is eased by gaining a carry.

In relation to the metal wood club head described in Japanese Patent Laying-Open No. 6-15016, however, there has been the following problem: That is, although the restitution characteristics increases by bonding the plastic material or the composite material having a small elastic coefficient to the face part, steps are complicated due to occurrence of a molding step of molding the deposit in a fit shape and a bonding step of mounting the deposit. Further, there has been such a problem that separation of a foreign material after hitting takes place.

On the other hand, there has been the following problem also in relation to the metal wood club head described in Japanese Patent Laying-Open No. 9-192269. That is, the position of the center of gravity must be lowered in order to locate the sweet spot under the face center. Therefore, working for mounting a high specific gravity material on the sole or the like is required, and a cost takes place. Further, there has also been such a problem that it is difficult to control the thickness since the head material is deeply drawn for attaining the roll shape.

DISCLOSURE OF INVENTION

Accordingly, the inventor has solved the aforementioned problems and come to propose an invention related to a metal wood club head which is a head manufactured by the same system material at a small manufacturing cost and improving restitution characteristics of the head. The same system material mentioned here indicates that including the material itself and an alloy with at least two types of other metals.

A metal wood club head according to the present invention comprises a face part, a back part, a crown part forming an upper portion from the face part to the back part and a sole part forming a lower portion from the face part to the back part, and has a hollow hull structure. The vertical difference between a maximum face part height (MFH) from the sole part and a back part height (BH) from the sole part is at least within 25 mm, the height of the crown part having a width of 30% to 70% of a head width from the sole part is substantially identical to the maximum face part height (MFH) or more than that and the vertical difference between a maximum crown part height (MCH) from the sole part and the maximum face part height (MFH) is at least within 8 mm, and it has set the radius (R1) of curvature of the crown part substantially uniformly within the range of 100 mm to 1000 mm, set the radius (R2) of curvature of the sole part substantially uniformly within the range of 500 mm to 2000 mm, and set the ratio of thicknesses of the crown part and the sole part within the range of 1.0 to 1.2.

It is preferable to set the radius (R3) of curvature of a roll of the aforementioned face part to at least 254 mm and not more than 381 mm, and to set the radius (R4) of curvature of a bulge to at least 254 mm and not more than 381 mm.

The ratio of the maximum face part height (MFH) and a maximum face part width (MFW) is preferably at least 0.5.

The thickness of the face part is preferably at least 1.0 mm and not more than 3.0 mm.

The area of the face part is preferably at least 3300 $mm^2$ and not more than 7500 $mm^2$.

It is preferable to form a bulging zone on a top portion of the crown part from the face part to the back part. The height of this bulging zone is preferably at least 0.1 mm and not more than 4 mm, and the width is preferably at least 10 mm and not more than 20 mm.

The material for the face part is a single metal material, and the face part is preferably molded without performing solution treatment after forging the metal material.

BEST MODE FOR CARRYING OUT THE INVENTION

Figure 1:
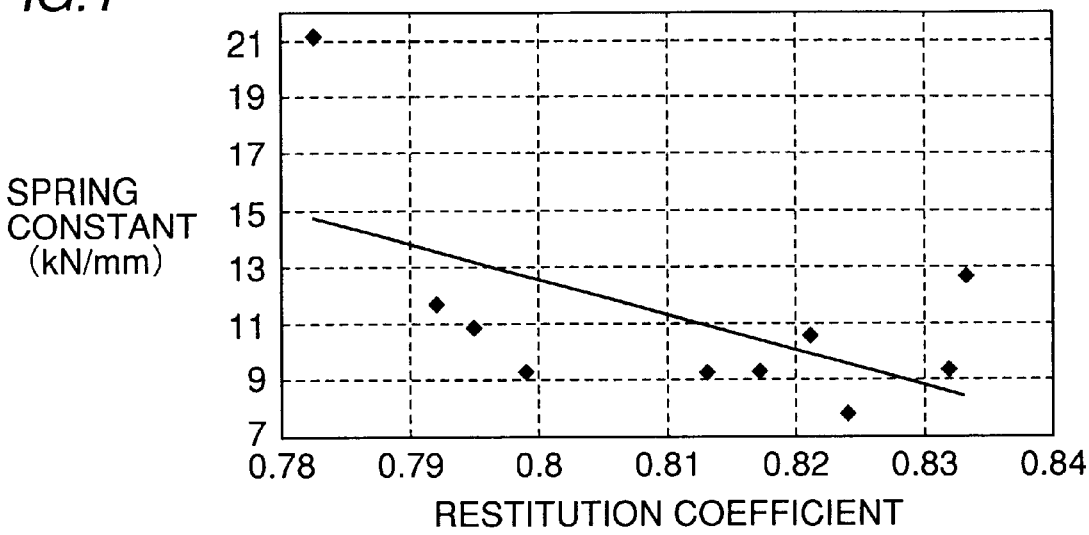
FIG. 1 is a graph showing the relation between values obtained by calculating the ratios with respect to bending distortion quantities of a face part as spring constants and restitution coefficients.

A metal wood club head according to the present invention comprises a face part 2, a back part 9, a crown part 3 forming an upper portion from the face part 2 to the back part 9 and a sole part 4 forming a lower portion from the face part 2 to the back part 9, and has a hollow hull structure.

The vertical difference between a maximum face part height (MFH) from the sole part 4 and a back part height (BH) from the sole part 4 is at least within 25 mm, the height of the crown part 3 having a width of 30% to 70% of a head width (HW) from the sole part 4 is substantially identical to the maximum face part height (MFH) or more than that, and the vertical difference between a maximum crown part height (MCH) from the sole part 4 and the maximum face part height (MFH) is at least within 8 mm, and it has set the radius (R1) of curvature of the crown part 3 substantially uniformly within the range of 100 mm to 1000 mm, set the radius (R2) of curvature of the sole part 4 substantially uniformly within the range of 500 mm to 2000 mm, and set the ratio of thicknesses of the crown part 3 and the sole part 4 within the range of 1.0 to 1.2.

It is preferable to set the radius (R3) of curvature of a roll of the aforementioned face part 2 to at least 254 mm and not more than 381 mm, and to set the radius (R4) of curvature of a bulge to at least 254 mm and not more than 381 mm. Further, the ratio of the maximum face part height (MFH) and a maximum face part width (MFW) is preferably at least 0.5.

The thickness of the face part 2 is preferably at least 1.0 mm and not more than 3.0 mm, and the area of the face part 2 is preferably at least 3300 $mm^2$ and not more than 7500 $mm^2$.

It is preferable to form a bulging zone 8 on a top portion of the crown part 3 from the face part 2 to the back part 9. The height of this bulging zone 8 is preferably at least 0.1 mm and not more than 4 mm, and the width is preferably at least 10 mm and not more than 20 mm.

By setting it in such a structure, it is possible to prevent such saying that the crown part is deflected in response to deflection of the face when hitting a ball as in the prior art, suppress the quantity of deformation of a golf ball and minimize energy loss, whereby restitution characteristics of the golf ball are improved and the carry increases.

The material for the face part 2 is a single metal material, and the face part 2 is preferably molded without performing solution treatment after forging the metal material.

Iron, stainless, aluminum, titanium, magnesium, tungsten, copper, nickel, zirconium, cobalt, manganese, zinc, silicon, tin, chromium and the like which are materials frequently employed when making a club head in general can be exemplified as materials capable of forming the aforementioned wood club head, and the cost is reduced by manufacturing the wood club head with a single material of these.

The wood club head according to the present invention is manufacturable also by precision casting, die casting, pressing or forging.

As desirable material structures in the present invention, a cold-rolled material of a β-system titanium alloy (15-3-3-3) can be used as the member of the face part, and a hot-forged material of the β-system titanium alloy (15-3-3-3) can be used as the member for the crown part, the sole part or the neck part.

It is preferable to set the volume of the metal wood club head according to the present invention in the range of 300 ml to 400 ml for working the same into a product.

Example of the metal wood club head according to the present invention is now described.

That is, in order to increase restitution characteristics of the metal wood club head 1, it is necessary to reduce rigidity of the face part 2, i.e., that the quantity of deflection of the face part 2 is large. It is now described.

FIG. 1 shows the relation between restitution coefficients obtained through a numerical formula 1 by selecting some golf heads, colliding a golf ball GB to sweet spots SS of metal wood club heads and measuring speeds before and after the collision and values obtained by calculating ratios with respect to quantities of bending deflection of face parts at the time of supplying a load of 5 kN to sweet spots SS of the face parts as spring constants. Data of FIG. 1 are set to Vin=40 m/s, and the horizontal axis shows the restitution coefficients. Pinnacle GOLD (Pinnacle GOLD LS) marketed by ACUSHNET COMPANY is used as the golf ball.

$$Vout/Vin=(eM-m)/(M+m) \quad (1)$$

Vout: golf ball speed after collision

Vin: golf ball speed before collision

M: head weight m: golf ball weight e: restitution coefficient

Thus, it is understood that the spring constant and the restitution coefficient are extremely correlated and the restitution coefficient is high in that of a face part having a large quantity of deflection.

In order to increase the restitution coefficient, therefore, it becomes important to apply a contrivance of increasing the quantity of deflection of the face part.

Accordingly, the inventive contents of a head increasing the quantity of deflection of a face part, manufactured by the same system material, and having a small manufacturing cost are described.

Figure 2A:
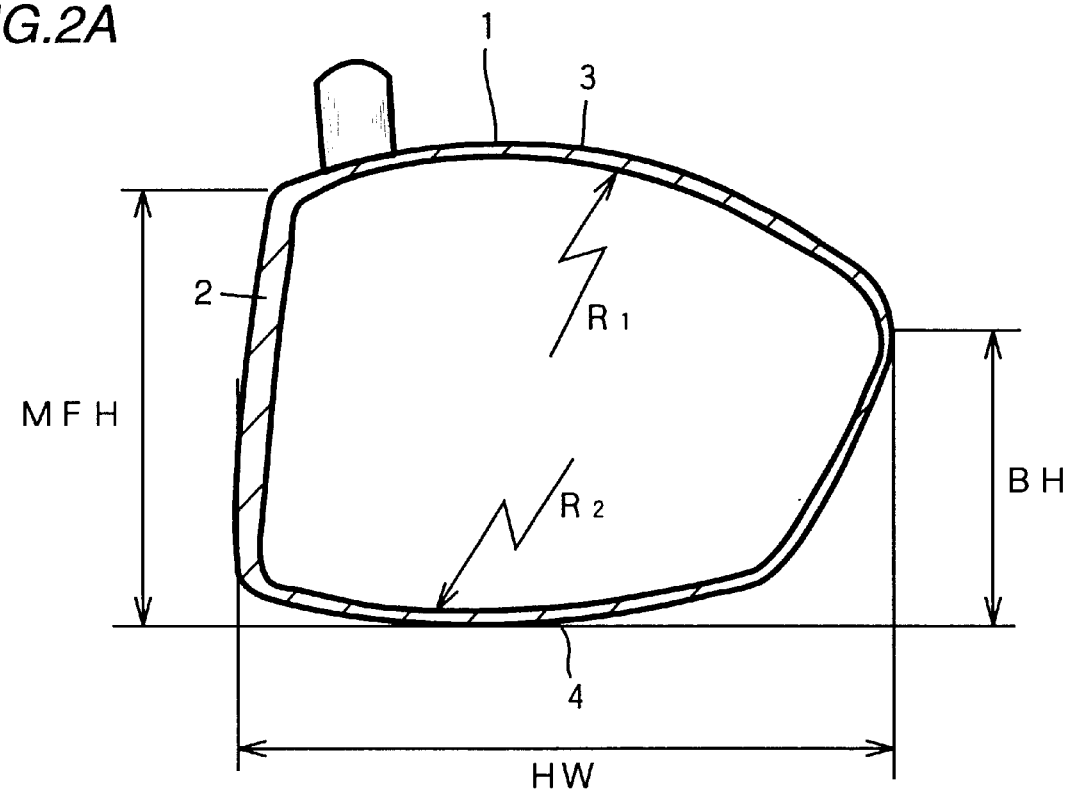
FIG. 2A and FIG. 2B are diagrams showing a section around a face part center for illustrating the theory of a metal wood dub head according to the present invention.
Figure 2B:
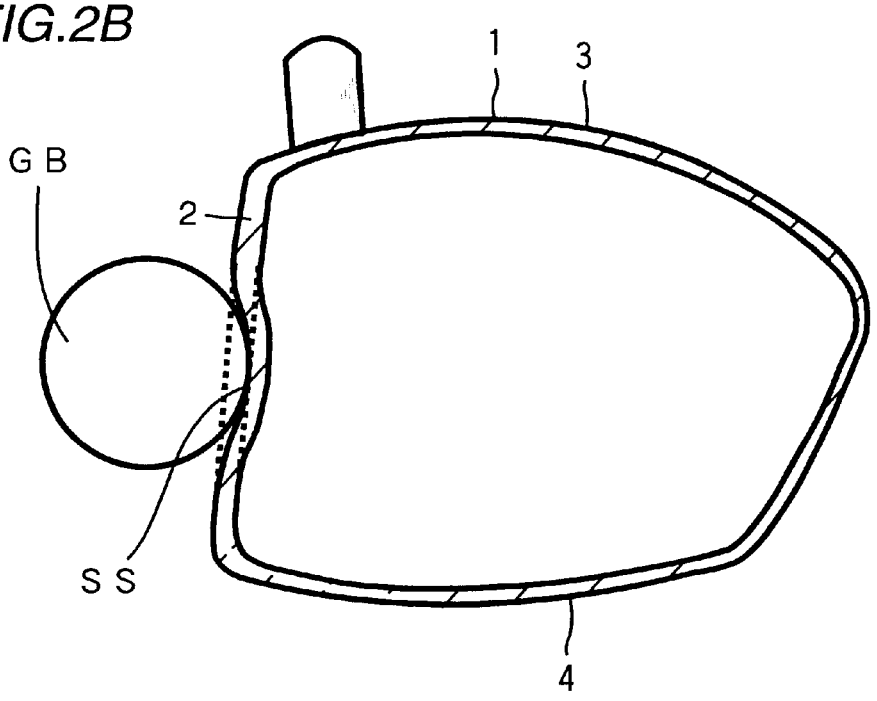
Figure 3A:
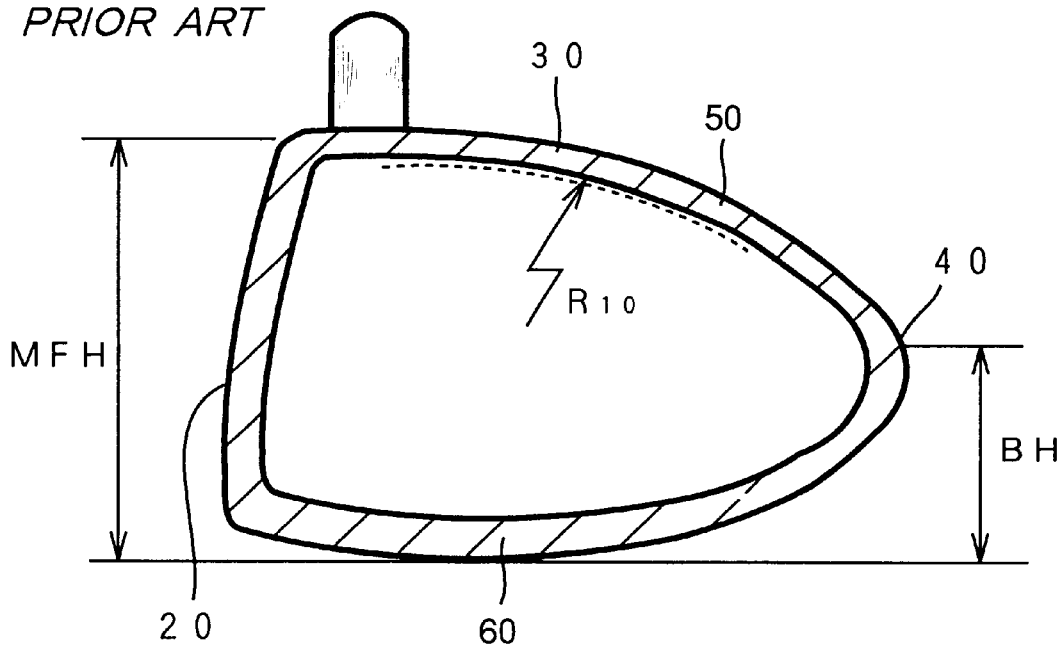
FIG.3A PRIOR ART
FIG. 3A and FIG. 3B are diagrams showing a section around a face part center for illustrating the theory of a conventional metal wood club head.

FIG. 2A and FIG. 2B are diagrams for illustrating the principle of the present invention, FIG. 2A is a sectional view around the center of the face part 2 of the metal wood club head 1 according to the present invention, and FIG. 3A is a sectional view around the center of a face part 20 of a conventional metal wood club head 30.

Referring to FIG. 3A, the height on the side of a back part 40 is lowered in the conventional metal wood club head 30 for lowering the center of gravity, the radius R10 of curvature of a crown part 50 is reduced, and a sole part 60 is rendered thicker than the crown part 50 for increasing the weight of the sole part 60.

In the metal wood club head 1 according to the present invention, as shown in FIG. 2A, the difference between its face part height FH and a back part height BH is small, the radius R1 of curvature of the crown part 3 and the radius R2 of curvature of the sole part 4 are large, and the thicknesses of the crown part 3 and the sole part 4 are substantially identical.

Figure 3B:
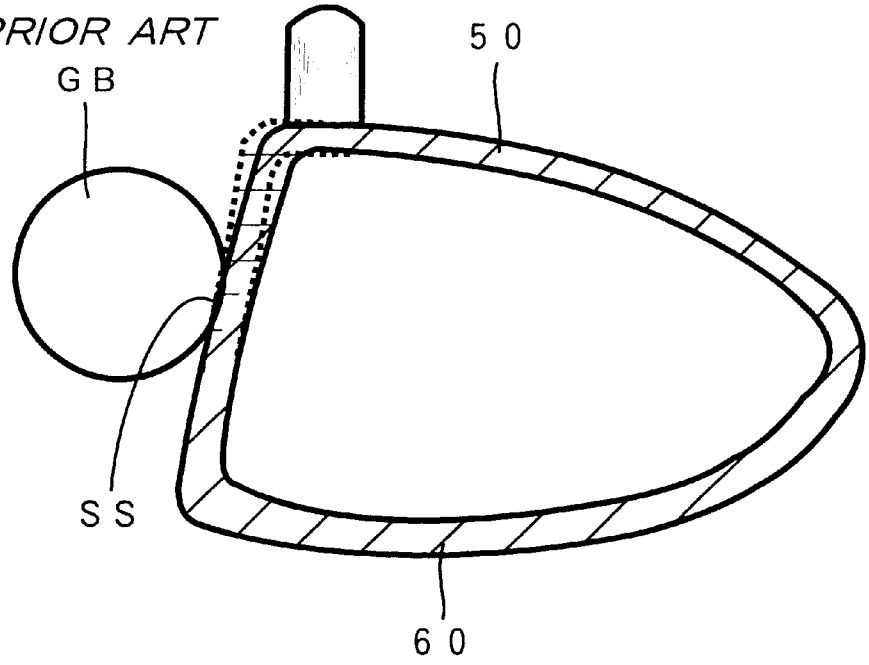
FIG.3B PRIOR ART

In the case of the conventional metal wood club head 30, the radius R10 of curvature of the crown part 50 is small, and deformation of the metal wood club head 30 is as shown in FIG. 3B when a ball collides. That is, bending deformation (portions displayed in dotted lines express states before hitting) of the crown part 50 and the sole part 60 takes place other than the face part 20, and cantilever deformation (deformation similar to a cantilever whose one end is fixed) fixing the sole part 60 also takes place, and hence the quantity of bending deformation of the face part 20 reduces.

Further, there is difference between the thicknesses of the crown part 50 and the face part 20, and hence the quantities of deformation thereof are different and cantilever deformation more readily takes place.

As in the inventive product of FIG. 2B, on the other hand, the radii R1 and R2 of curvature of the crown part 3 and the sole part 4 are extremely large, the thicknesses thereof are hardly different, and the height of the crown part 3 having a width of at least 30% to 70% of the head width HW is substantially identical to the maximum face part height MFH or more than that. Therefore, most of the crown part 3 and the sole part 4 are subjected to only compression deformation, and the quantities thereof are substantially equivalent.

Therefore, it is such a structure that cantilever deformation also hardly takes place and only deflection of the face part 2 readily takes place. Therefore, it is understood that deflection of the face part 2 of the inventive product enlarges as compared with the conventional product. Here, the radius R1 of curvature of this crown part 3 is preferably in the range of 100 mm to 1000 mm, and it is desirable that the radius R2 of curvature of the sole part 4 is in the range of 500 mm to 2000 mm.

Further, the thickness of the crown part 3 and the thickness of the sole part 4 are desirably about 1 to 1.2 mm. In addition, it hits a ball around the center of the face part 2, and hence it is desirable that the radius R1 of curvature for forming the crown part 3 and the radius R2 of curvature for forming the sole part 4 are substantially uniformly large at least around the center of the face part 2 and the thickness of the crown part 3 and the thickness of the sole part 4 are also substantially identical (the ratio of the thicknesses is about 1.0 to 1.2).

Then, quantities of deflection at the time of applying constant force to face parts 2 having radius R4 of curvature of various types of bulges were calculated. Table 1 shows calculation results of relative values in the case of regarding such a one that the radius R4 of curvature of a bulge is 203.2 mm is 1.0000.

TABLE 1

| Radius $R_4$ of Curvature of Bulge (mm) | Quantity of Deflection |
|---|---|
| 203.2 | 1.0000 |
| 228.6 | 1.4238 |
| 254.0 | 1.9531 |
| 279.4 | 2.5996 |
| 304.8 | 3.3750 |
| 330.2 | 4.2910 |
| 355.6 | 5.3594 |
| 381.0 | 6.5918 |

Figure 6:
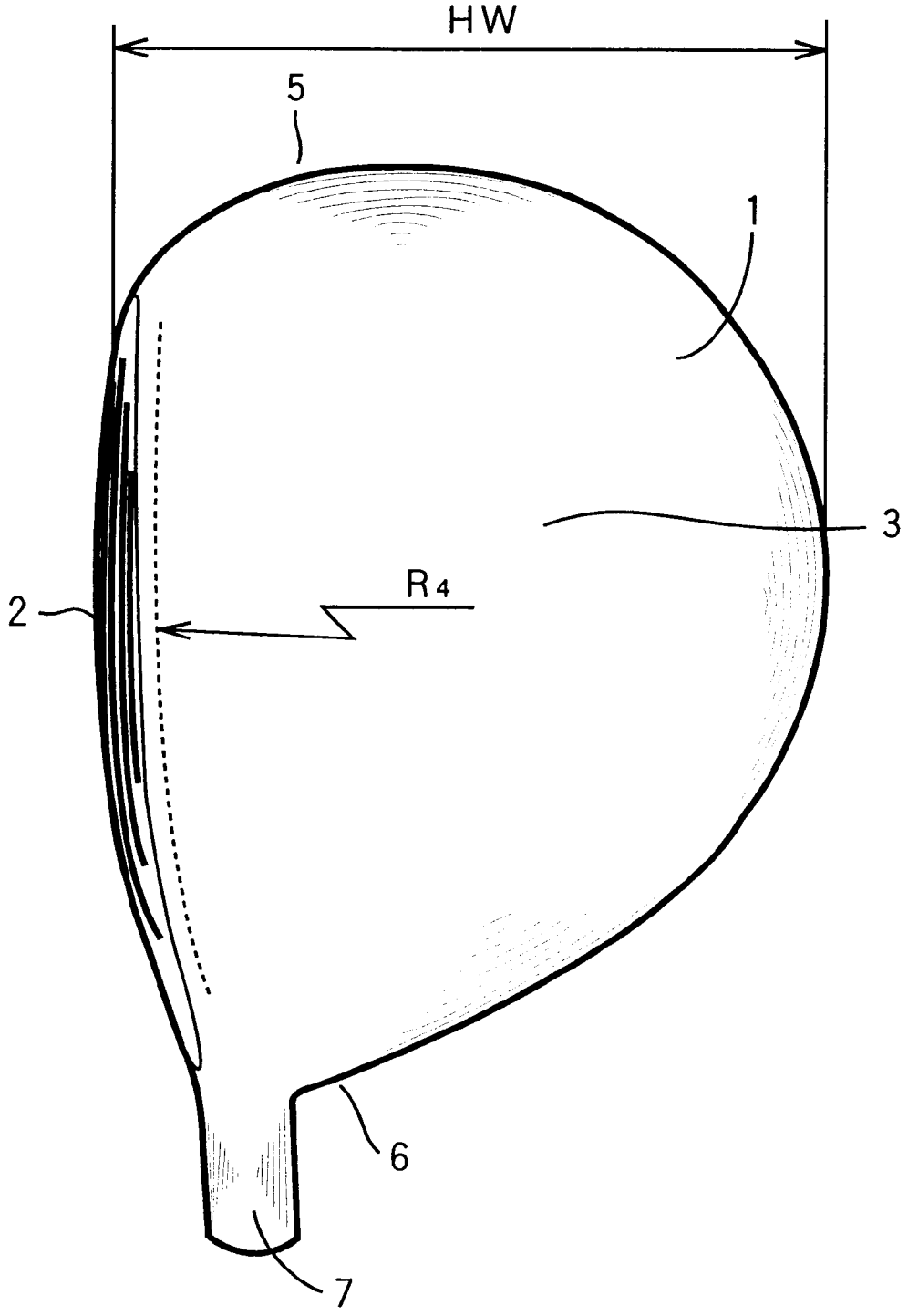
FIG. 6 is a plan view of the metal wood club head according to the present invention.

It is understood that the quantity of deflection increases as the radius R4 of curvature of a bulge shown in FIG. 6 enlarges. From this, the inventive product having the large radius R4 of curvature of the bulge is such that the quantity of deflection increases and the restitution coefficient rises.

The radius R4 of curvature of this bulge is desirably at least 254 mm and not more than 381 mm, and the radius R3 of curvature of a roll is also desirably at least 254 mm and not more than 381 mm for a similar reason.

Figure 4:
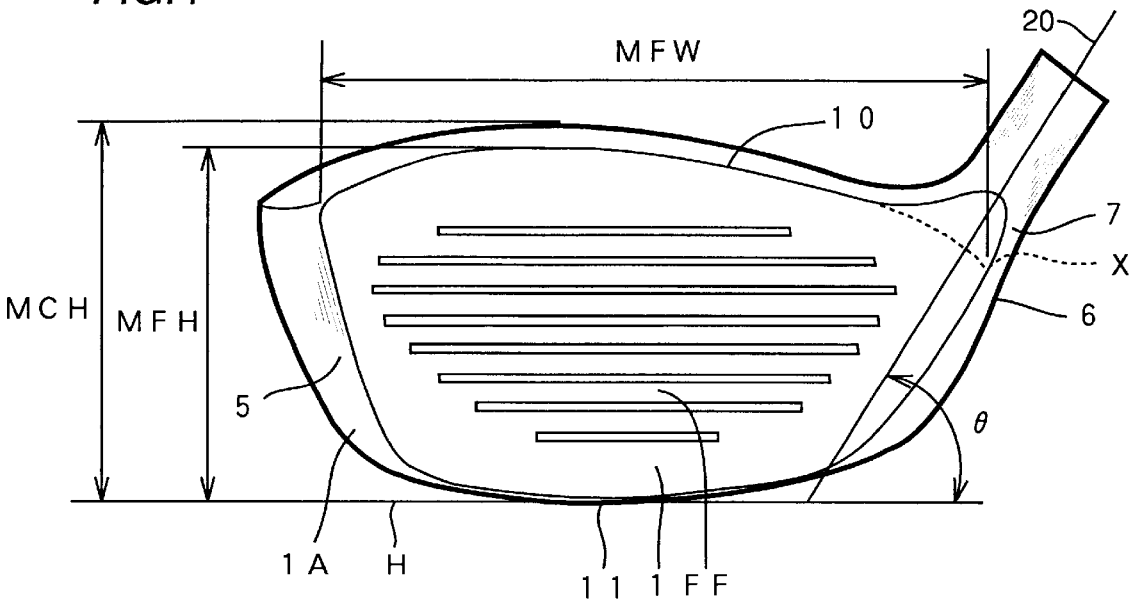
FIG. 4 is a front elevational view showing the metal wood dub head according to the present invention.
Figure 5:
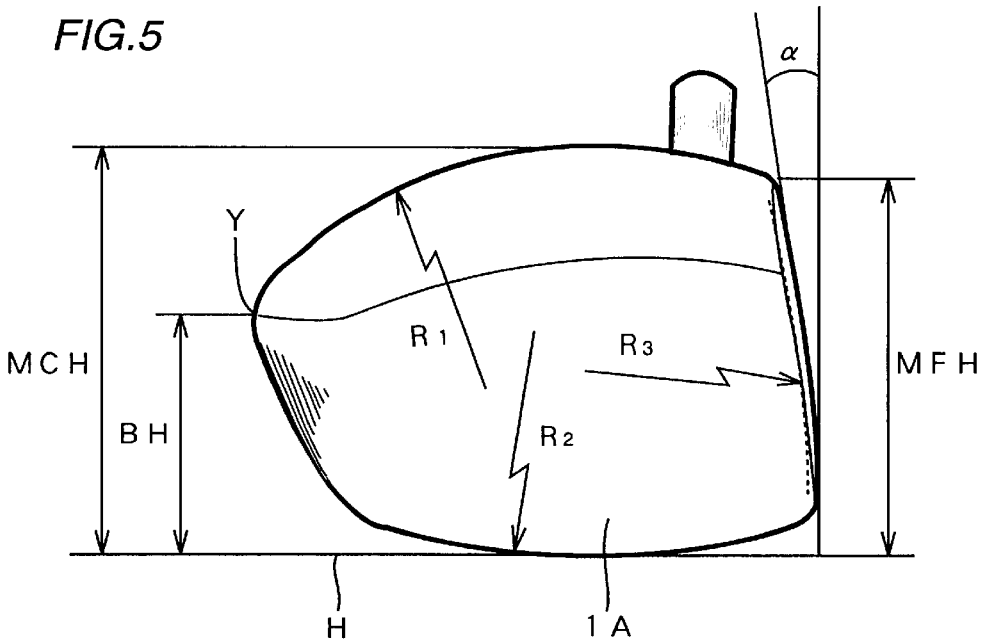
FIG. 5 is a side elevational view showing a toe side of the metal wood club head according to the present invention.

Then, as in FIG. 4 or FIG. 5, it is assumed that an intersection obtained by extending a curve having the same radius of curvature as the radius of curvature of the outline of a top edge portion 10 of the face part 2 in the vicinity of a neck part 7 from the top edge portion 10 to a heel part 6 of the face part 2 and intersecting the same with the outline of the face part 2 is X, and a region reaching a toe part 5 from the point X of the heel part 6 through a leading edge part 11 from the toe part 5 through the top edge portion 10 is defined as a face part front surface FF. It is assumed that the maximum height from a horizontal plane H in the vertical direction of the face part front surface FF is the maximum face part height MFH, and the maximum length portion in the direction from the toe part 5 to the heel part 6 is defined as the maximum face part width MFW.

Table 2 shows results obtained by calculating to what extent quantities of deflection change by vertical and transverse shape ratios when applying a constant load in the case of assuming the same face part area FA with reference to the case of setting the area to 3600 $mm^2$, for example. Referring to FIG. 4, 20 denotes the axis of a shaft.

The values shown in Table 2 are obtained by varying the vertical and transverse lengths of rectangular shapes on the assumption that the quantity of deflection in the case where the shape of the face part 2 is circular is 1, for calculating the ratios of deflection.

It is understood that the ratio of deflection reduces when the aspect ratio which is the ratio of the vertical and transverse lengths of the rectangular shape reduces as shown in FIGS. 7A to 7D and FIGS. 8A to 8C.

Therefore, the quantity of deflection enlarges as the vertical and transverse lengths of the rectangular shape are close, and hence it is rather preferable that the aspect ratio is large.

Considering the metal wood club head, therefore, such design that, regarding the maximum face part height MFH and the maximum face part width MFW as the length and breadth, the ratio of the lengths is large is excellent, and the ratio thereof is desirably at least 0.5.

TABLE 2

Figure 7A:
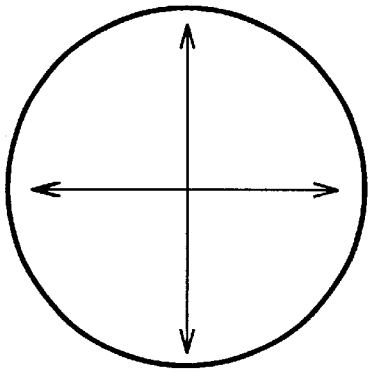
FIG. 7A to FIG. 7D are explanatory diagrams showing ratios of deflection quantities depending on face part shapes according to the present invention.
Figure 7B:
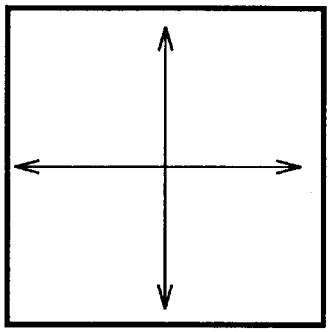
Figure 7C:
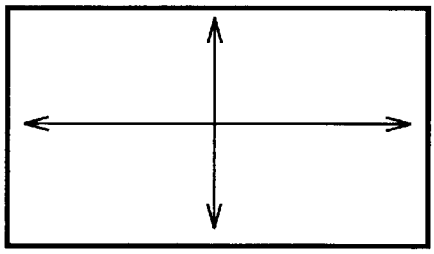
Figure 7D:
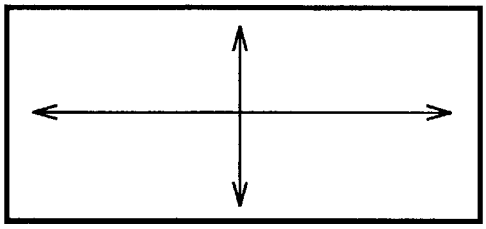
Figure 8A:
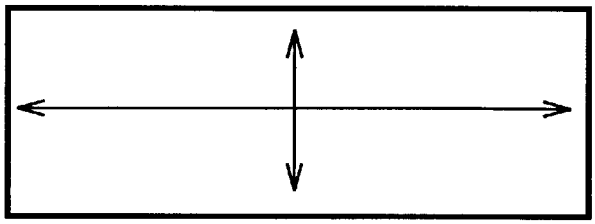
FIG. 8A to FIG. 8C are explanatory diagrams showing ratios of deflection quantities depending on face part shapes according to the present invention.
Figure 8B:
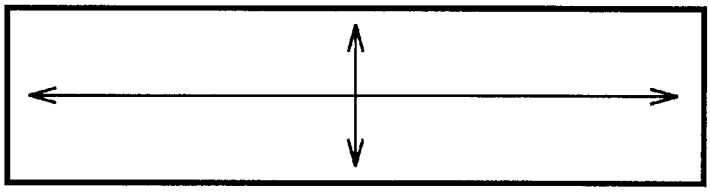
Figure 8C:
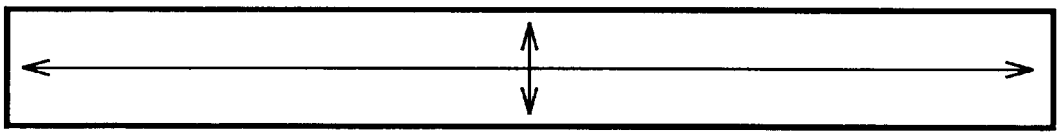

| Circle | Radius (cm) | (cm) | | Deflection Ratio |
|---|---|---|---|---|
| FIG. 7A | 3.39 | 3.39 | | 1.00 |
| Rectangular Shape | Vertical | Transverse | Aspect Ratio | |
| FIG. 7B | 6.0 | 6.0 | 1.00 | 0.95 |
| FIG. 7C | 8.0 | 4.5 | 0.56 | 0.91 |
| FIG. 7D | 9.0 | 4.0 | 0.44 | 0.88 |
| FIG. 8A | 10.0 | 3.6 | 0.36 | 0.82 |
| FIG. 8B | 12.0 | 3.0 | 0.25 | 0.75 |
| FIG. 8C | 18.0 | 2.0 | 0.11 | 0.60 |

As to the thickness of the face part 2, it is obvious that a thinner one is deflected, while a certain thickness is necessary for this since breakage takes place on the face part due to impact caused when repeatedly hitting a ball if it is too thin. The thickness of the face part 2 is desirably at least 1 mm and not more than 3 mm.

As to the face part area, it is obvious that having a larger face part area is deflected also in this, and it is desirably at least 3300 $mm^2$ and not more than 7500 $mm^2$ in the metal wood club head.

Another Example of the present invention is now described.

A metal wood club head of this Example has been manufactured by the same system material while reducing rigidity of a face part, i.e., increasing the quantity of deflection of the face part in order to increase restitution characteristics.

In this Example, the radius R1 of curvature R1 for forming a crown part 3 along a section around the center of the face part 2 is substantially uniformly 110 mm, and the radius R2 of curvature for formation of a sole part is substantially uniformly 900 mm, as shown in FIGS. 2A and 2B, FIG. 5 and FIG. 6.

Further, a crown thickness is 1 mm, a sole thickness is 1.1 mm, the radius R4 of curvature of a bulge is 254 mm, and the radius R3 of curvature of a roll is 254 mm.

The maximum crown part height MCH is 52.5 mm, while the maximum face part height MFH is 49.8 mm, the maximum face part width MFW is 99.2 mm, and the ratio of the maximum face part height MFH and the maximum face part width MFW is 0.51.

The back part height BH is the height of a crown-side vertex Y of a back part 9 at the time of virtually cutting a head body 1A vertically from the face part 2 to the back part 9 through the center of gravity of the metal wood club head 1 when setting the head body 1A on a horizontal plane H in a state set to prescribed loft angle θ and lie angle α, as shown in FIG. 4 or FIG. 5.

The back part height BH is 30.0 mm, further the face part area FA is 36.1 $mm^2$, the face part thickness is 2.8 mm, and the head of this Example is a wood club head forged from a titanium alloy plate.

The spring constant which is the ratio to the quantity of bending deflection of the face part at the time of supplying a load of 5 kN to the sweet spot SS of the face part 2 of the present invention was 0.74 kN/mm, and the restitution coefficient was 0.831.

When making investigation as to a conventional product, the spring constant was 2.1 kN/mm and the restitution coefficient was 0.793.

Figure 9:
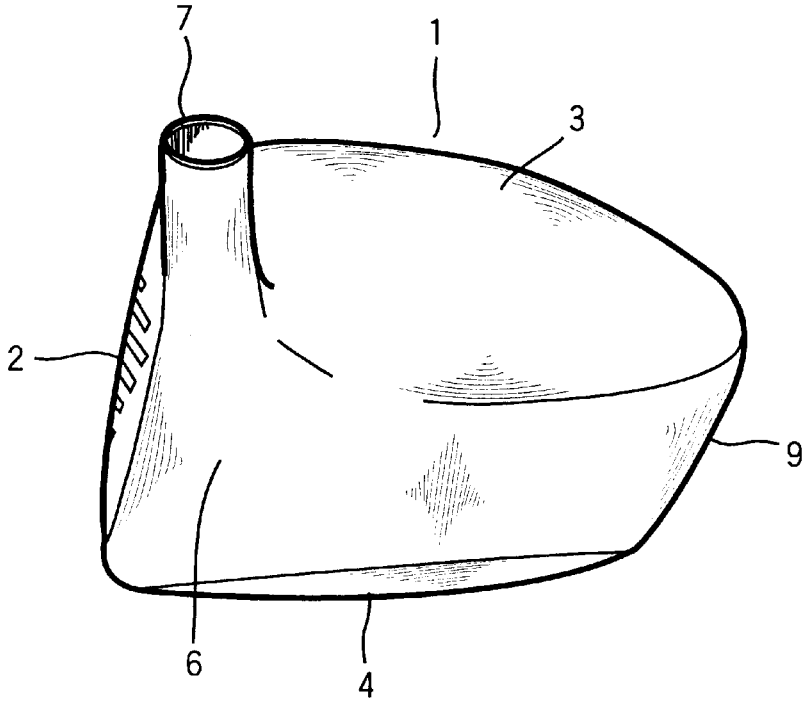
FIG. 9 is a side elevational view showing a heel part of the metal wood club head according to the present invention.
Figure 10:
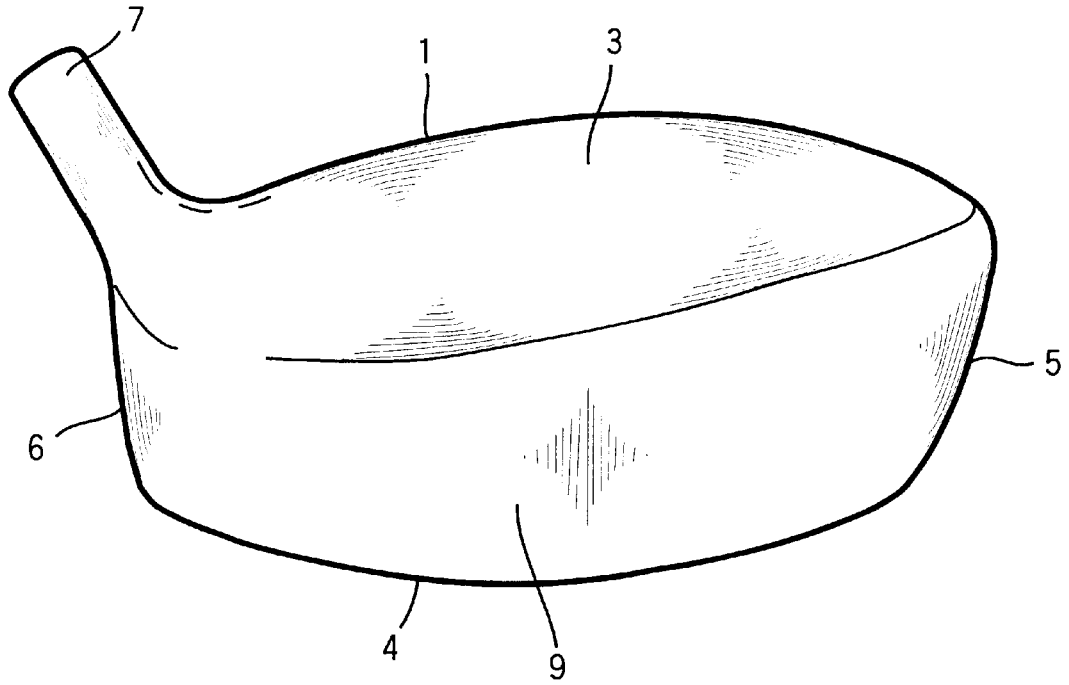
FIG. 10 is a rear elevational view showing a back part side of the metal wood club head according to the present invention.

In the metal wood club head according to the present invention, in addition, the widths of the back part 9, the toe part 5 and the heel part 6 are thickly formed although the volume of the head body 1A is large at 300 ml as shown in FIG. 6, FIG. 9 or FIG. 10, and hence, when observing the head body 1A from above, it appears small and compact as compared with the conventional head exceeding 300 ml. For a golfer having had a feeling of misfit on a conventional head appearing large, therefore, it produces such an effect that he can make address with no feeling of misfit.

Figure 11:
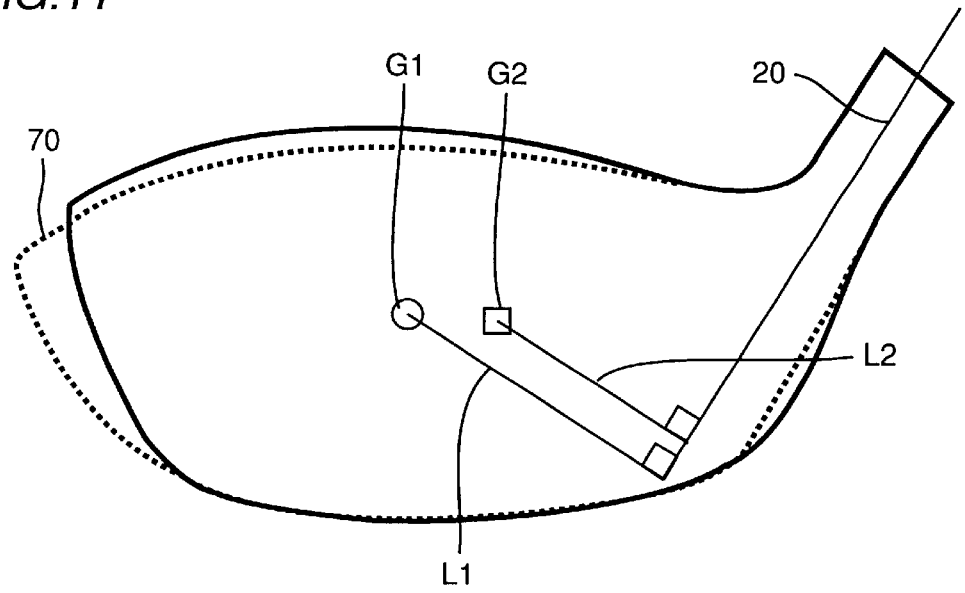
FIG. 11 is an explanatory diagram showing comparison of barycentric distances of the metal wood club head according to the present invention and a generally known metal wood club head.

In the metal wood club head 1 according to the present invention, further, the distance L2 between the center G2 of gravity and a shaft central axis 20 of the inventive product can be reduced to 34.5 mm as compared with the distance L1 (37 to 40 mm) between the center G1 of gravity and a shaft central axis 20 of a conventional metal wood club head 70 having volume of 300 ml, as shown in FIG. 11. Thus, particularly when hitting a ball while twisting the wrist at the time of impacting a golf ball similarly to an upper-class golfer, the moment of inertia around the shaft axis reduces and it readily rotates. Consequently, store-up hitting can be readily performed and the head speed increases, whereby the carry of the golf ball improves and the directivity also becomes excellent.

Figure 12:
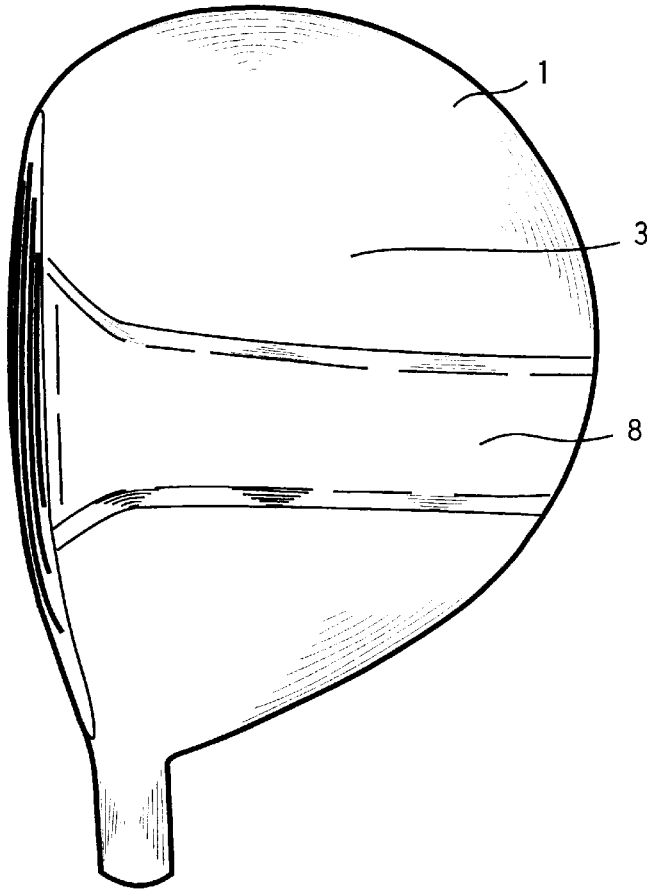
FIG. 12 is a diagram showing another Example of the metal wood club head according to the present invention.

Still another Example is now described. As shown in FIG. 12, a bulging zone 8 of at least 0.1 mm and not more than 4 mm in height and at least 10 mm and not more than 20 mm in width may be formed on a top portion from a face part 2 to a back part 9 in a crown part 3 of a metal wood club head 1.

Further, the material for the face part of the present invention is molded without performing solution treatment after forging. Thus, residual stress in an alloy is extracted and high strength is attained.

According to the metal wood club head of the present invention, as hereinabove described, such a remarkable effect is attained that the carry can be increased by bringing the metal wood club head of extra-large volume into a compact appearance shape, providing no feeling of misfit also when used by an upper-class one, and further remarkably improving restitution characteristics of the metal wood club head.

According to the present invention, further, it is possible to provide such a metal wood club head that twisting of the wrist becomes easy particularly for an upper-class golfer and the carry as well as the directivity can be readily controlled.

While embodiments of the present invention have been described as described above, the embodiments disclosed this time must be considered as illustrative in all points and not restrictive. The scope of the present invention is shown by the scope of claims for patent, and it is intended that all modifications in the meaning and range equivalent to the scope of claims for patent are included.

INDUSTRIAL APPLICABILITY

The present invention is effectively applicable to a metal wood club head.

What is claimed is:

1. A metal wood club head of a hollow hull structure comprising a face part (2), a back part (9), a crown part (3) forming an upper portion from said face part (2) to said back part (9) and a sole part (4) forming a lower portion from said face part (2) to said back part (9), wherein the vertical difference between a maximum face part height (MFH) from said sole part (4) and a back part height (BH) from said sole part (4) is at least within 25 mm, the height of said crown part (3) having a width of 30% to 70% of a head width from said sole part (4) is substantially identical to said maximum face part height (MFH) or more than that, and the vertical difference between a maximum crown part height (MCH) from said sole part (4) and said maximum face part height (MFH) is at least within 8 mm, said metal wood club head setting the radius (R1) of curvature of said crown part (3) substantially uniformly within the range of 100 mm to 1000 mm while setting the radius (R2) of curvature of said sole part (4) substantially uniformly within the range of 500 mm to 2000 mm, and setting the ratio of thicknesses of said crown part (3) and said sole part (4) within the range of 1.0 to 1.2.

2. The metal wood club head according to claim 1, setting the radius (R3) of curvature of a roll of said face part (2) to at least 254 mm and not more than 381 mm and setting the radius (R4) of curvature of a bulge to at least 254 mm and not more than 381 mm.

3. The metal wood club head according to claim 1, wherein the ratio of said maximum face part height (MFH) and a maximum face part width (MFW) is at least 0.5.

4. The metal wood club head according to claim 1, wherein the thickness of said face part (2) is at least 1.0 mm and not more than 3.0 mm.

5. The metal wood club head according to claim 1, wherein the area of said face part (2) is at least 3300 $mm^2$ and not more than 7500 $mm^2$.

6. The metal wood club head according to claim 1, forming a bulging zone (8) on a top portion of said crown part (3) from said face part (2) to said back part (9).

7. The metal wood club head according to claim 6, wherein the height of said bulging zone (8) is at least 0.1 mm and not more than 4 mm, and the width of said bulging zone (8) is at least 10 mm and not more than 20 mm.

8. The metal wood club head according to claim 1, wherein the material for said face part (2) is a single metal material, and said face part (2) is molded without performing solution treatment after forging said metal material.

* * * * *

UNITED STATES PATENT AND TRADEMARK OFFICE

CERTIFICATE OF CORRECTION

PATENT NO. : 6,402,639 B1 
DATED : June 11, 2002
INVENTOR(S) : Mototaka Iwata et al.

It is certified that error appears in the above-identified patent and that said Letters Patent is hereby corrected as shown below:

Title page,
Item [73], Assignee, please add the name of the second Assignee:
-- K.K. Endo Seisakusho, Niigata, Japan --

Signed and Sealed this

Twenty-fifth Day of February, 2003

JAMES E. ROGAN
*Director of the United States Patent and Trademark Office*